US007721378B2

(12) United States Patent
Ostrobrod

(10) Patent No.: US 7,721,378 B2
(45) Date of Patent: May 25, 2010

(54) COMBINED EXTENDABLE POLE AND COUNTERBALANCE SYSTEM FOR WASHING THE WINDOWS OF A BUILDING

(76) Inventor: Meyer Ostrobrod, 2070 Bennett Rd., Philadelphia, PA (US) 19116

( * ) Notice: Subject to any disclaimer, the term of this patent is extended or adjusted under 35 U.S.C. 154(b) by 489 days.

(21) Appl. No.: 11/825,923

(22) Filed: Jul. 10, 2007

(65) Prior Publication Data

US 2009/0013483 A1 Jan. 15, 2009

(51) Int. Cl.
*A47L 1/00* (2006.01)
*A47L 13/50* (2006.01)
*A47L 3/00* (2006.01)

(52) U.S. Cl. ..... 15/160; 15/1; 15/220.1; 15/246; 15/257.01; 134/172; 401/48; 248/325; 254/266; 242/385.1

(58) Field of Classification Search ..... 15/1, 15/103, 160, 220.1, 232, 246, 257.01; 134/172, 134/198; 226/129, 167; 242/385.1–385.3, 242/396.2–396.4; 248/123.11, 123.2, 125.2, 248/325; 254/4 R, 4 B, 266, 270; 294/67.5; 401/48, 195

See application file for complete search history.

(56) References Cited

U.S. PATENT DOCUMENTS

| | | | | |
|---|---|---|---|---|
| 975,474 | A * | 11/1910 | Stadt et al. | 15/220.1 |
| 4,511,123 | A | 4/1985 | Ostrobrod | |
| 6,394,972 | B1 | 5/2002 | Slishman | |
| 6,913,587 | B2 | 7/2005 | Slishman | |
| 2005/0123344 | A1 | 6/2005 | Bensussan | |

* cited by examiner

*Primary Examiner*—Mark Spisich
(74) *Attorney, Agent, or Firm*—Norman E. Lehrer

(57) ABSTRACT

A combined extendable pole and counterbalance system for washing the windows of a building includes an elongated pole including a handle portion adjacent the lower end thereof and a window cleaning utensil adjacent the upper end. The handle portion is adapted to be grasped by a workman while standing on the ground. An elongated flexible line is suspended from the roof or some other an upper part of the building above the windows to be washed. The line extends downwardly toward the ground and is connected to the pole. A spring driven drum biases the line upwardly thereby lifting part of the weight of the pole. The line is preferably connected to the pole adjacent the handle portion thereof but passes around and is guided by a pulley located adjacent the upper end of the pole so as to stabilize the upper end of the pole to prevent it from falling from side to side.

6 Claims, 3 Drawing Sheets

COMBINED EXTENDABLE POLE AND COUNTERBALANCE SYSTEM FOR WASHING THE WINDOWS OF A BUILDING

BACKGROUND OF THE INVENTION

The present invention is directed toward a window washing pole arrangement and, more particularly, toward a counterbalance for use with a window washing pole that reduces the strain and fatigue on the arms of a window washer and also decreases the risk of injury to the window washer and others nearby. The invention also decreases the risk damage to the window washing pole and to property in the vicinity.

Extendable poles for window washing are well known in the art and are widely used. Typically, scaffolding or a support lowered from a roof is used when cleaning windows on very tall buildings or on a building having seven or eighth floors or more. On the other hand, extendable poles are typically used for washing the windows on shorter buildings and sometimes for windows located on the lower five or six floors of taller buildings. These poles normally have a handle section at the bottom and a brush at the top. In addition, a fluid supply line within or carried outside of the pole carry water or cleaning fluid up to the brush.

There are, however, several problems with using such poles. For example, in one known system, the poles typically have several telescoping sections. This makes the pole rather heavy and somewhat cumbersome to use from the ground even when the pole is collapsed or telescoped in. The weight of the pole puts substantial strain on the arms of the window washer who must move the entire pole, brush and fluid up and down repeatedly. This causes great fatigue thereby reducing the amount of work that a window washer can perform.

In another type of extendable pole known in the art, several sections are provided that may each be six to feet long. The sections are releasably connected to each other end to end such as by a threaded connection, locking tabs, or the like. Cleaning fluid passes up through the center of the pole. When only the lowermost section is used to wash the windows on the bottom floor, the pole may not be particularly heavy. However, when five or six sections are interconnected, the combined pole along with the brush and fluid may weigh fifty pounds or more.

U.S. Published Patent Application No. 2005/0123344 to Bensussan discloses quick release connections for an extensible pole used to extend the reach of a variety of tools, such as a window washing implement. This pole also, when extended, may be rather heavy and cumbersome.

The weight of the pole, with the resultant fatigue on the window washer's muscles is not the only negative of such prior art systems. Because of the length of the pole, particularly in its fully extended position, it is unstable and can easily tilt to the left or right when being used and can fall causing damage to the pole or the building or other objects in the area. The falling pole may also cause injury to bystanders or to persons passing by.

Therefore, a need exists for an extendable pole system for washing windows that will not cause fatigue in a window washer and that will not cause damage or injury due to the pole accidentally falling.

SUMMARY OF THE INVENTION

The present invention is designed to overcome the deficiencies of the prior art discussed above. Accordingly, it is an object of the invention to provide an extendable pole and counterbalance system for window washing that is easier to use than prior systems.

It is a further object of the present invention to provide an extendable pole and counterbalance system for window washing that requires less effort to use, thereby reducing fatigue of the window washer.

It is a still further object of the invention to provide an extendable pole and counterbalance system for window washing that greatly reduces the probability of damage to property or injury to people in the vicinity of the windows being washed.

In accordance with the illustrative embodiments demonstrating features and advantages of the present invention, there is provided a combined extendable pole and counterbalance system for washing the windows of a building which includes an elongated pole including a handle portion adjacent the lower end thereof and a window cleaning utensil such as a brush adjacent the upper end. The handle portion is adapted to be grasped by a workman while standing on the ground. An elongated flexible line is suspended from the roof or some other an upper part of the building above the windows to be washed. The line extends downwardly toward the ground and is connected to the pole. A spring driven drum biases the line upwardly thereby lifting part of the weight of the pole. The line is preferably connected to the pole adjacent the handle portion thereof but passes around and is guided by a pulley located adjacent the upper end of the pole so as to stabilize the upper end of the pole to prevent it from falling from side to side.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawing one form which is presently preferred; it being understood that the invention is not intended to be limited to the precise arrangements and instrumentalities shown.

DETAILED DESCRIPTION OF THE PREFERRED EMBODIMENT

Figure 1:
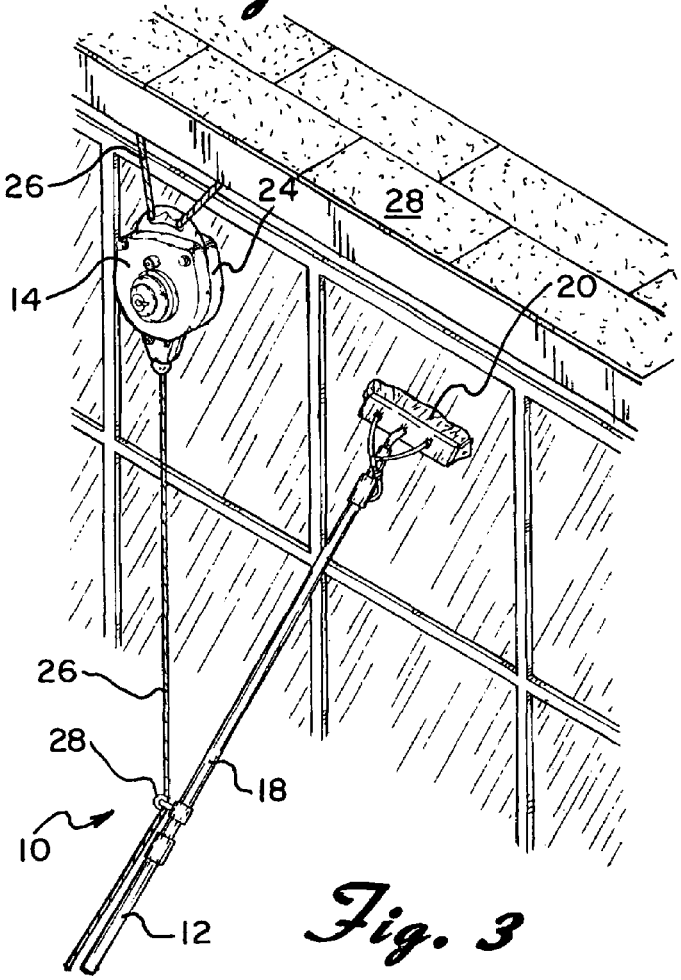
FIG. 1 is a perspective view of a portion of the extendable pole and counterbalance system for washing windows of the present invention shown in use washing windows.
Figure 2:
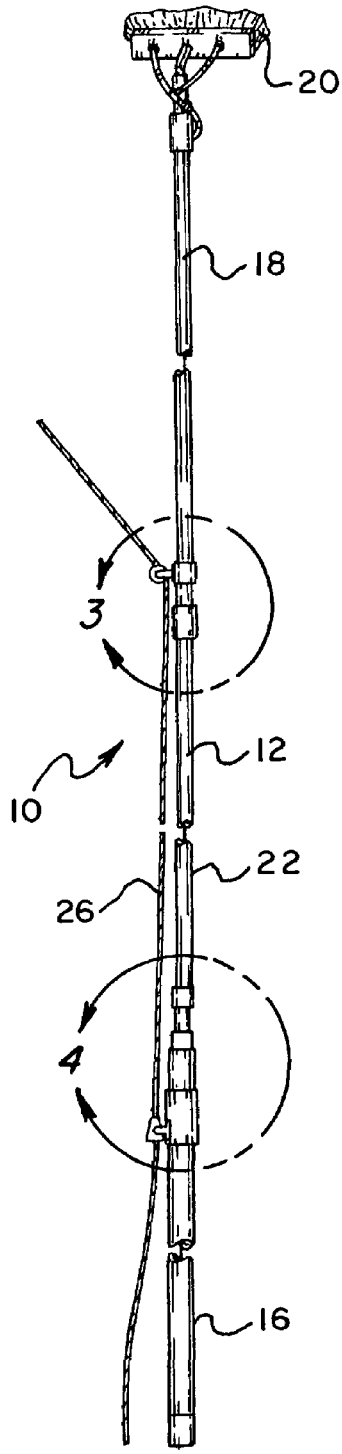
FIG. 2 is front perspective view of the window washing pole shown in FIG. 1.

Referring now to the drawings in detail wherein like reference numerals have been used throughout the various figures to designate like elements, there is shown in FIGS. 1 and 2 an extendable pole and counterbalance system for washing windows constructed in accordance with the principles of the present invention and designated generally as 10. The system 10 is comprised essentially of two main components. The first is the extension pole 12 and the second being the counterbalance device 14.

With minor exception, the extension pole 12 is conventional and can be essentially any known extendable window washing pole available in the market place. It can be of the type that extends and contracts using telescoping parts or of the type wherein a plurality of pole sections are joined end to end. In the illustrated embodiment of the invention, the extension pole 12 is of the latter type where a plurality of pole sections are joined end to end.

Irrespective of the type of extension pole being used, there is normally a bottom handle portion 16 and an uppermost pole section 18 that carries a brush 20 or other window cleaning utensil at the top thereof. Known window washing poles that can be utilized with the present invention also normally include a fluid supply line (not shown) for carrying water or other liquid or window washing fluid from a supply near the ground up to the brush 20. The fluid supply line is sometimes carried on the outside of the pole or can be located within the pole. There can also be more than one fluid supply line for supplying two different fluids from the ground up to the brush 20. In some known arrangements, the interior of the pole itself becomes the supply line for the fluid. The manner in which the cleaning fluid is supplied to the brush 20 is known in the art and the details thereof will not, therefore, be described. It is significant to note, however, that the fluid supply line and the fluid passing up through the height of the pole to the brush 20 can add significant weight to the pole.

As pointed out above, in the illustrated embodiment of the invention, the extension pole 12 is of the type where a plurality of pole sections are joined together end to end. As shown most clearly in FIG. 2, there are essentially three pole sections shown. The bottommost section is the handle portion 16 which is adapted to be grasped by a workman while standing on the ground. The uppermost section 18 carries the brush 20. Located between the handle portion 16 and the upper portion 18 are intermediate pole sections. Only one such intermediate pole section 22 is shown in FIG. 2. It should be apparent to those skilled in the art, however, that this is by way of illustration only. When the windows on the upper floors of a building are being washed, it may be necessary to insert two, three or four additional intermediate pole sections 22 into the extendable pole 12. Each of the pole sections including the handle portion 16 and the uppermost portion 18 in addition to the intermediate sections 22 may be approximately 6 to 10 feet in length. Preferably all of the intermediate sections 22 are constructed to be identical to each other so that they can be more easily and quickly assembled on the job.

When the windows of a building are being washed, it is most common to wash the upper windows first before moving down to the middle and lower windows. This is accomplished by inserting as many intermediate pole sections 22 as necessary or extending a telescoping pole to the length necessary to do the upper windows. Once the uppermost windows are done and it is desired to shorten the pole, the bottom thereof is normally moved away from the building somewhat until the workman can reach the joint between the first intermediate pole section 22 and the top of the handle portion 16. If separate pole sections are used, the poles are disconnected, the lowermost intermediate pole 22 is removed and the next one is attached to the top of the handle portion 16. Alternatively, if a telescoping pole is used, the locking mechanism at the top of the handle portion 16 is released so that the next telescoping portion can telescope downwardly into the handle.

With known window washing poles currently in use, difficulties are experienced in raising the pole to do the upper windows. Normally, the various sections of the pole must be assembled on the ground to the full length that is desired and then lifted up into position. Because of the length of the pole (which could be 60 or 70 feet) a great deal of strength is needed to lift the same from the horizontal ground position up to the vertical position. Accidents can frequently occur when this is done damaging the pole or other property or injuring the window washer or others in the vicinity. Similarly, while it may not take much force to wash the lowermost windows when only a single pole section may be needed, when multiple pole sections are assembled to do the upper windows, the workman moving his arms up and down to wash the windows can tire very quickly. Furthermore, the extended pole can tilt left to right and fall. With telescoping poles, washing even the lowermost windows can cause fatigue since the entire weight of the pole must still be moved up and down even though the pole has been collapsed. The counterbalancing device 14 of the present invention eliminates all of these problems.

The basic portion and operation of the counterbalancing device 14 is, per se, well known. With the exception discussed below, it is constructed essentially the same as a safety device used to prevent a worker from falling such as described, for example, in U.S. Pat. No. 4,511,123. The entire subject matter of that patent is incorporated herein by reference.

As shown most clearly in FIG. 1, the counterbalancing device 14 includes a housing 24 which is suspended by a cable 26 or the like from the roof 28 of the building above the windows being washed. In the simplest form of the invention, there can be a plurality of hooks or the like (not shown) mounted on or near the roof across the width of the building so that the counterbalancing device 14 can be manually moved from one position to another, as needed. If desired, a more complex arrangement could be provided including some type of automatic or manually operated means such as a cart or the like riding on a track for moving the counterbalancing device 14. A flexible line 26 extends downwardly from the housing 24 of the counterbalancing device 14 from the upper part of the building toward the ground.

Figure 3:
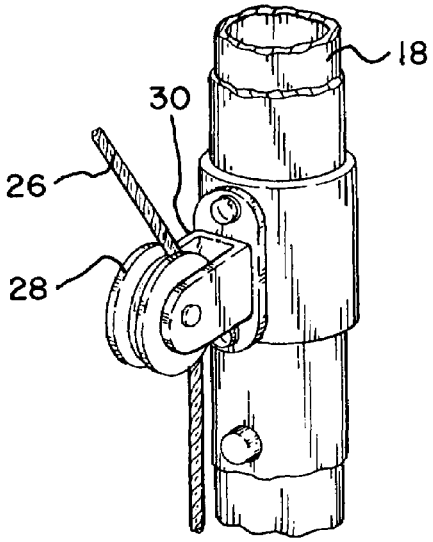
FIG. 3 is an enlarged view of the section identified by the arrows 3 in FIG. 2.

The upper section 18 of the pole 12 includes a pulley 28 that is secured thereto as best shown in FIGS. 1, 2 and 3. The flexible line 26 passes around the pulley as it continues downwardly. The pulley 28 is mounted to the pole section 18 through the use of a U-shaped bracket 30 so that the line 26 is essentially captured and cannot be dislodged from the pulley. As will become more apparent hereinafter, the flexible line 26 passing around the pulley 28 stabilizes the upper end of the pole 12 and helps to prevent it from falling.

Figure 4:
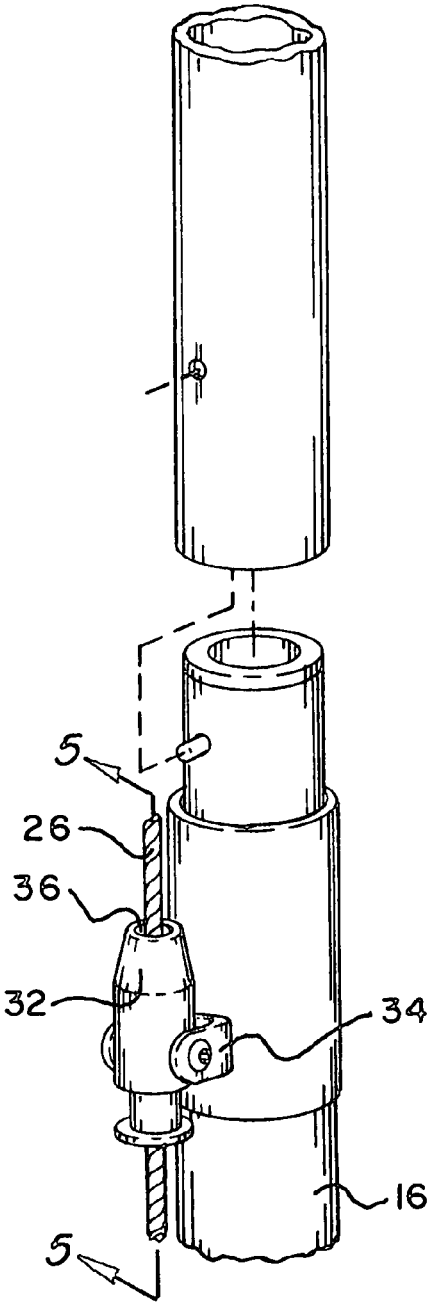
FIG. 4 is an exploded and enlarged view of the section identified by the arrows 4 in FIG. 2.
Figure 5:
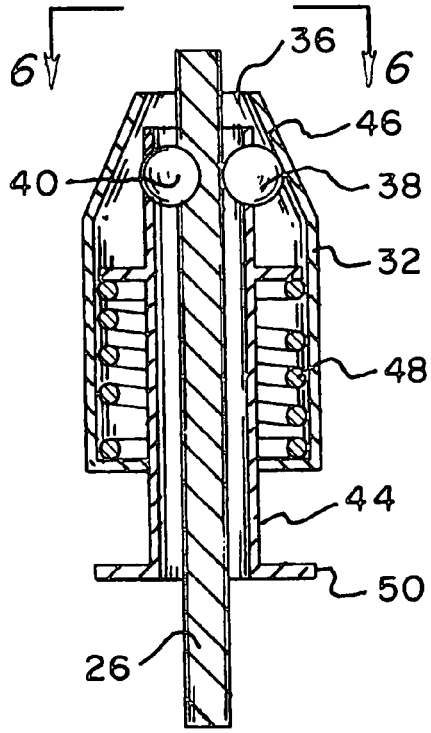
FIG. 5 is a partial cross-sectional view taken through the lines 5-5 of FIG. 4.
Figure 6:
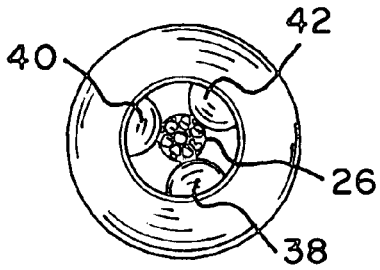
FIG. 6 is a partial cross-sectional view taken through the lines 6-6 of FIG. 5.

Mounted to the handle portion 16 adjacent the upper end thereof is a cable grab or stop 32 as best shown in FIGS. 4, 5 and 6. The stop 32 is likewise secured to the handle portion 16 through the use of a U-shaped bracket 34.

The cable 26 passes downwardly through the center 36 of the stop 32 with a length of the line 26 continuing out of the bottom of the stop as shown most clearly in FIG. 2. The stop 32 is, per se, well known in the art. It allows the line 26 to be pulled downwardly through the center of the stop but prevents upward movement of the line. This is accomplished by three metal ball bearings 38, 40 and 42 that are guided in slots in a movable plunger 44 so that they are movable axially and radially as the plunger moves.

The inner wall of the top of the cable grab or stop 32 is tapered inwardly such as shown at 46. Thus, as the plunger 44 moves upwardly and carries the balls 38, 40 and 42 with it, the balls are cammed inwardly to grip the line 26 and prevent axial movement thereof. A spring 48 biases the plunger 44 upwardly so that the balls 38, 40 and 42 are normally locking the line 26 in place to prevent movement thereof. If the line is pulled downwardly from below the cable grab 32, however, the balls and plunger tend to move downwardly thereby releasing the force on the line 26 allowing it to be drawn downwardly. When it is desired to allow the line 26 to move upwardly, the handle 50 at the bottom of the plunger 44 is manually pulled down thereby releasing the balls 38, 40 and 42 from the line 26.

Figure 7:
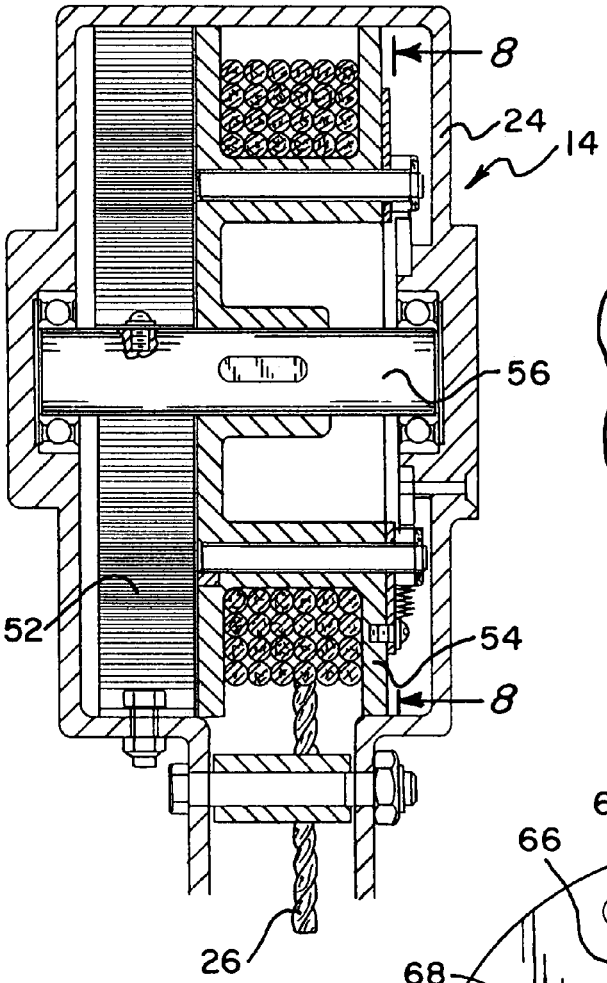
FIG. 7 is a partial cross-sectional view of the counterbalancing device used with the invention shown in the upper part of FIG. 1.

The flexible line 26 is normally biased upwardly so as to help lift and support the weight of the window washing pole 12. As shown most clearly in FIG. 7 and as more fully described in U.S. Pat. No. 4,511,123 referred to above, this is accomplished by a spiral spring 52 within the housing 24 of the counterbalancing device 14. Also located within the housing 24 is a drum 54. The drum 54 is mounted for rotation about the axis 56. A hundred feet or more of the flexible line 26 may be initially wound on the drum 54. As the flexible line 26 is pulled downwardly out of the counterbalancing device 14, the spiral spring 52 is wound creating an upward force on the line 26. As is well known in the art, the upward biasing force on the line 26 is less when only a small amount of line has been withdrawn from the housing 24 but increases as more and more line is withdrawn.

Since there is a constant upward force or bias on the line 26, if a workman assembling the window washing pole 12 and connecting the line 26 thereto should accidentally release his grip on the line, the line would move upwardly and be wound up into the housing 24 adjacent the roof 28 of the building. This would create substantial additional work and time since a workman would have to ascend to the top of the building and again lower the line 26 to the ground. To prevent this from occurring, the counterbalancing device 14 is provided with a centrifugal brake shown most clearly in FIGS. 8 and 9.

Figure 9:
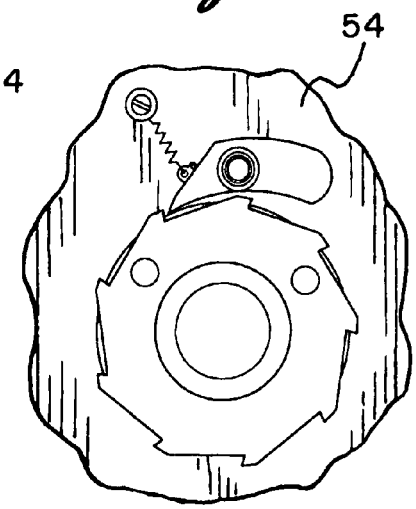
FIG. 9 is a partial cross-sectional view similar to FIG. 8 but showing the brake of the invention in the engaged position.
Figure 8:
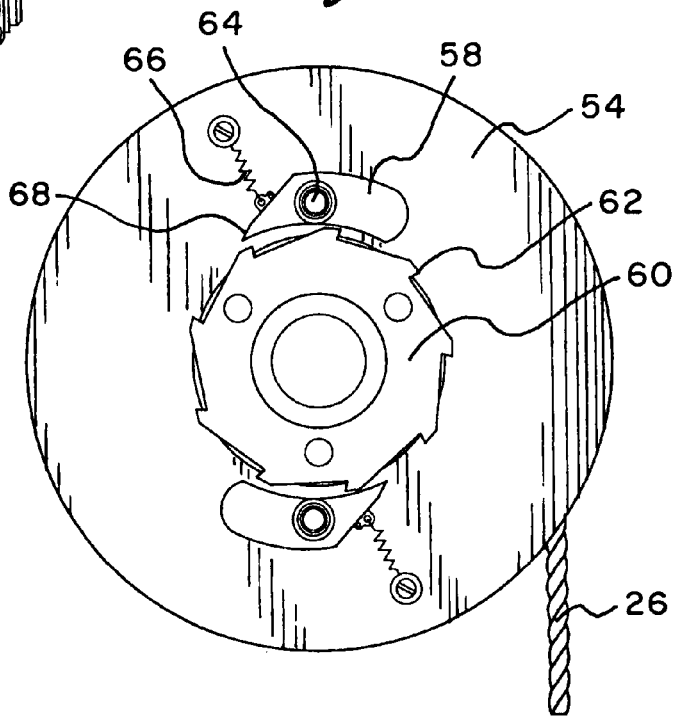
FIG. 8 is a partial cross-sectional view taken through the lines 8-8 of FIG. 7.

Pivotally secured to the drum 54 so as to rotate therewith are one or more moveable pawls 58. Secured to the housing 14 and fixed therewith so as to be immoveable is a ratchet wheel 60 having a plurality of teeth 62 thereon. The pawl 58 is pivoted about its own pivot point 64 and is heavier at its right side as shown in FIGS. 8 and 9 than on the left side thereof. A spring 66 biases the left end 68 of the pawl 58 radially outwardly so as not to engage any of the teeth 62 of the ratchet wheel 60 as shown in FIG. 8.

As shown in FIGS. 8 and 9, when the line 26 is retracting into the housing 24 of the counterbalancing device 14 through the force of the spiral spring 52, the drum 54 is rotating counterclockwise. If the drum is rotating slowly and in a controlled manner, the end 68 of the pawl 58 will remain out of engagement with the teeth 62 of the ratchet wheel 60. In the event, however, that the line 26 begins to move upwardly too quickly and out of control, the drum 54 will rotate more quickly. The right end of the pawl 58 will then move radially outwardly by centrifugal force against the force of the spring 66 and the tip 68 of the pawl 58 will engage one of the teeth 62 of the ratchet wheel 60 thereby stopping the movement of the drum 54. This will, in turn, prevent the line 26 from inadvertently being drawn upwardly into the counterbalancing device 14. If adjusted properly, not more than a few inches of line 26 will move upwardly before it automatically stops.

As explained above and as is well known in the art, the tension or upward force on the line 26, as it is withdrawn from the counterbalancing device 14, increases as the amount of line withdrawn increases. This is not of particular concern when utilizing a telescoping pole. This is because the weight of the pole is substantially the same whether it is fully extended or fully collapsed. Thus, the amount of upward force needed to counterbalance the weight of the telescoping pole and reduce fatigue on the arm muscles of the workman is substantially constant. Thus, if the line 26 is connected to the lower end of the pole with an upward biasing force of 50 pounds and if the telescoping pole weights 50 pounds, there will be substantially no weight for the workman to lift whether the pole is extended or retracted.

The situation is different, however, with expandable poles such as those illustrated in the present drawings wherein additional intermediate pole sections 22 are added in order to increase the length of the pole. Obviously, the more pole sections that are added, the heavier the weight of the overall pole. This is the primary purpose of the rope grab or stop 32.

When only one or two pole sections are being utilized in washing the windows of the lower level of the building, the combined window washing pole 12 may weigh only 10 or 15 pounds or so. Less upward biasing force is, therefore, needed in order to support the pole. To accomplish this, less line 26 need be withdrawn from the counterbalancing device 14.

FIG. 2 shows the line 26 extending through and substantially below the stop 32. The upward force can be reduced by releasing the plunger 44 on the stop 32 and allowing the line 26 to move upwardly until the end thereof is adjacent the bottom of the stop 32. This will be in a position where there is the least upward biasing force. As pole sections are added to the expandable pole 12, the upward biasing force can be increased by simply drawing more line 26 through the stop 32. At any time during the use of the pole 12, the upward biasing force can be adjusted by simply adjusting the amount of line 26 that extends through the stop 32.

The present invention is utilized in the following manner. First, a workman ascends to the roof of the building and attaches the counterbalancing device 14 at a point above the column or columns of windows to be washed. As should be readily apparent, the counterbalancing device 14 need not be located directly vertically above the windows being washed. A window washer utilizing the present invention will benefit significantly from the same when washing the column of windows to the right of and to the left of the position of the counterbalancing device 14. Once the counterbalancing device 14 is in position, the workman withdraws sufficient line 26 out of the housing 24 to reach the ground.

On the ground, the window washer assembles the expandable pole 12 to its fullest length so as to be able to wash the windows on the upper floor of the building. The end of the line 26 is then passed around the pulley 28 and through the opening 36 in the stop 32. With the pole 12 assembled and the line 26 properly in place, the window washer lifts the pole into the vertical position. The lifting of the pole requires very little effort since it is aided by the upward biasing force from the counterbalancing device 14.

After the uppermost windows have been washed, an intermediate pole section 22 can be removed from the fully extended pole 12 in the same manner as is conventionally done and as is described above. There is no need to remove the line 26 since it is not interconnected with any of the intermediate pole sections 22. The same would be true of a telescope pole.

The present invention may be embodied in other specific forms without departing from the spirit or essential attributes thereof and accordingly, reference should be made to the appended claims rather than to the foregoing specification as indicating the scope of the invention.

I claim:

1. A combined extendable pole and counterbalance system for washing the windows of a building comprising:

an elongated pole including a handle portion adjacent the lower end thereof and a window cleaning utensil adjacent the upper end thereof, said handle portion being adapted to be grasped by a workman while standing on the ground;

an elongated flexible line;

means for suspending said line from an upper part of said building above the windows to be washed, said line extending from said upper part of said building toward the ground;

means biasing said line in an upward vertical direction, and means for connecting said line to said pole for lifting part of the weight of said pole upwardly.

2. A combined extendable pole and counterbalance system for washing the windows of a building as defined in claim 1 wherein said means for connecting said line to said pole connects the line adjacent the handle portion thereof.

3. A combined extendable pole and counterbalance system for washing the windows of a building as defined in claim 2 wherein said upper end of said pole includes a pulley around which said line passes to stabilize the upper end of said pole.

4. A combined extendable pole and counterbalance system for washing the windows of a building as defined in claim 1 wherein said biasing means includes a spiral spring connected to a drum, said line being wrapped around said drum and said spring tending to turn said drum to wind said line therearound.

5. A combined extendable pole and counterbalance system for washing the windows of a building as defined in claim 4 further including braking means for preventing said line from too quickly being wrapped around said drum by said spring.

6. A combined extendable pole and counterbalance system for washing the windows of a building as defined in claim 5 wherein said braking means is a centrifugal brake mounted on said drum.

* * * * *